United States Patent [19]

Ilukowicz

[11] 4,159,605

[45] Jul. 3, 1979

[54] PARKING CURB REINFORCING BAR SUPPORT

[75] Inventor: Robert J. Ilukowicz, Coram, N.Y.

[73] Assignee: Preco Industries Ltd., Plainview, N.Y.

[21] Appl. No.: 781,783

[22] Filed: Mar. 28, 1977

[51] Int. Cl.[2] ..... E04C 5/20

[52] U.S. Cl. ..... 52/687; 249/91

[58] Field of Search ..... 249/30, 91, 205, 207, 249/210; 52/677-689

[56] References Cited

U.S. PATENT DOCUMENTS

| | | | |
|---|---|---|---|
| 1,079,829 | 11/1913 | Bennett | 52/687 |
| 3,788,025 | 1/1974 | Holmes | 52/687 |

FOREIGN PATENT DOCUMENTS

| | | | |
|---|---|---|---|
| 532236 | 1/1941 | United Kingdom | 52/689 |

*Primary Examiner*—John McQuade

[57] ABSTRACT

A parking curb reinforcing bar support comprising of one piece plastic body with spaced support portions for respective reinforcing bars. Each portion includes a surrounding wall with an opening through which the associated reinforcing bar can be inserted and held within the support portion. The portions may be connected by a connection piece with projecting members extending laterally from the body and defining a plurality of support points by which the body can be stabily supported in a parking curb form.

3 Claims, 2 Drawing Figures

PARKING CURB REINFORCING BAR SUPPORT

FIELD OF THE INVENTION

This invention relates to parking curb reinforcing bar supports and the like adapted for supporting reinforcing bars within a parking curb form or the like.

BACKGROUND OF THE INVENTION

In the conventional type of concrete parking curbs (i.e., slender forms of semi-trapezoidal cross-section), reinforcing bars may be provided at the top and bottom. The bottom reinforcing bar is initially supported within the casting form for the curb by suitable means so as to hold the bar in position and the top bar is hand placed after pouring of the concrete into the form. Centering of the bars is accomplished by eye and usually is inaccurate by virtue of the lack of lateral restraint. Additionally, it is very difficult to place the top bar accurately at a given position in the concrete.

Some supports are known for supporting reinforcing bars in spaced positions. These include such supports as disclosed in U.S. Pat. Nos. 1,268,887; 1,880,710; 3,530,634; and 3,694,989 as well as in British Pat. No. 904,766. These known structures are believed to be less suitable for withstanding the weight of reinforcing bars then is desirable for the purpose.

SUMMARY OF THE INVENTIONS

An object of the invention is to provide a support member for reinforcing bars in a parking curb form, which will maintain such bars in given position so that they are accurately placed in the resulting concrete parking curb.

Another object of the invention is to provide a support member of the above type which includes a structure most suitably adapted for supporting the weight of reinforcing bars thereby being adapted for stably supporting the reinforcing bars within the form.

In accordance with the above and further objects, the invention contemplates a parking curb reinforcing bar support comprising a one-piece plastic body including spaced support portions for respective reinforcing bars, each portion including a surrounding wall with an opening through which the associated reinforcing bar can be inserted with a snap fit, means connecting said portions, and projecting members defining a plurality of support points by which the body can be stably supported in a form and the reinforcing bars held in predetermined positions within said form whereby the reinforcing bars will be placed within the cast body at pre-determined position therein.

In accordance with one embodiment of the invention, said support portions are aligned and said connection means comprises a straight connecting piece joining said support portions. The intersection of the transverse pieces provide support for an optional reinforcing bar.

In this embodiment, the projecting members preferably include two pairs of arms extending diagonally with respect to said straight connecting piece for engaging the side walls of the form to provide lateral restraint. Moreover, two of the projecting members projects from the bottom of the body in alignment with the connecting piece for support of the body on the bottom of the form.

In further accordance with the invention, the opening in each wall is smaller in size than the corresponding support portion whereby the reinforcing bars are forcibly inserted into the respective support portion and tightly maintained therein.

DETAILED DESCRIPTION

Figure 1:
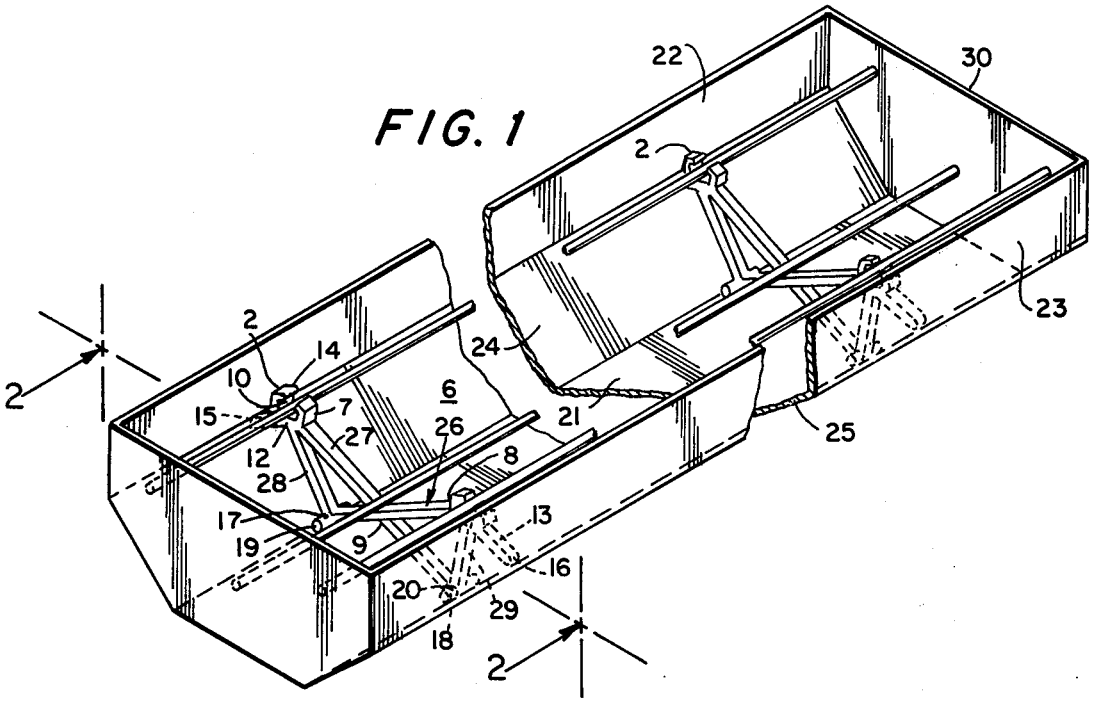
FIG. 1 is a perspective view, partly broken away showing a parking curb form with two supports and reinforcing bars mounted therein.

Referring to FIG. 1 of the drawing, therein is seen a form 1 of steel or other suitable material assembled in a cross-section best described as a trapezoid situated on a trapezoid for receiving concrete to produce a parking curb which is a reinforced concrete beam of semi-trapezoidal cross-section. Parking curbs are well known in the art. In use, parking curbs are placed side by side in a designated area to provide parking guide lines for motor vehicles.

In order to provide a strong product which will absorb any impact by a motor vehicle, it is necessary to provide reinforcing bars at the top and optionally at the bottom of the bumper curbs and in general, number 3 or 4 (⅜" or ½") steel bars are provided 1" from any side of the form. These bars are usually spaced symmetrically in exact horizontal alignment from the vertical axis of the parking curb.

Heretofore it was conventional to mount the lower reinforcing bar in the form by means of suitable clips or the like, and after the concrete was poured, the top bars, were handplaced in the concrete. Accurately locating was effected by eye and was usually inaccurate as there was no lateral restraint. Furthermore, it was very difficult to place the top reinforcing bar accurately at a depth of 1" or 1½" in the concrete.

The invention contemplates the placement of at least two support members 2 within the form 1 so as to support and maintain reinforcing bars 3, 4 and 5 therewithin at pre-determined locations. Namely, the support members 2 position the reinforcing bars 3 and 4 equidistant from the center plane of the form and at specific distances from the top and bottom thereof. The intersection of the transverse connection pieces accurately position the reinforcing bar 5 in the center plane of the form 1½" from the bottom. The support of the reinforcing bars 3, 4 & 5 members 2 is such that their position will be undisturbed in the course of pouring of concrete, whereby the reinforcing bars will occupy precise position in the cast slat.

Figure 2:
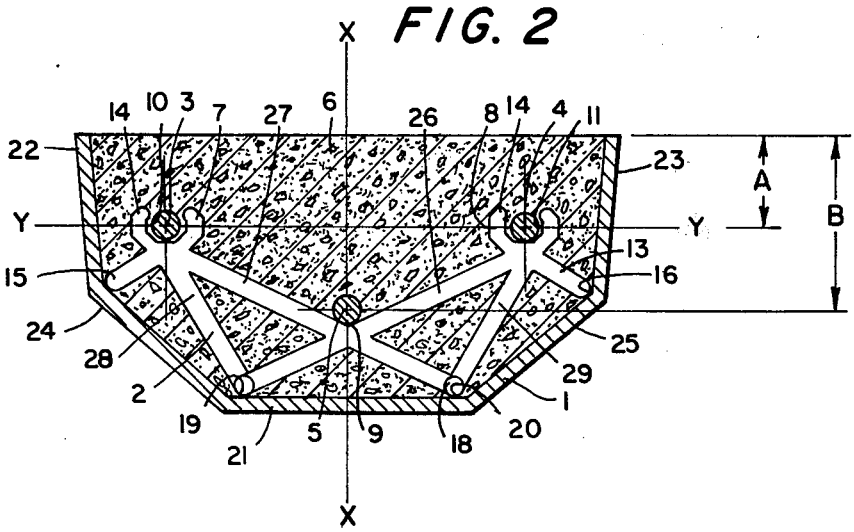
FIG. 2 is a transverse sectional view taken along line 2—2 in FIG. 1 showing one embodiment of the invention.

Referring more specifically to FIG. 2, therein it can be seen that the reinforcing bars 3 and 4 are placed in exact horizontal alignment equidistant from the vertical axis of symmetry of the form 1. Reinforcing bar 5 is placed along the vertical axis 1½" from the bottom of the form. Moreover, the centers of bars 3, 4, & 5 are respectively positioned at distances A and B from the top and bottom of the cast slat 6.

By virtue of the perfectly centered position of the bars 3, 4 & 5, an accurate position of the reinforcing bars will be obtained in the parking curb and this produces a high quality curb which is of constant strength and is reliable in use in parking areas while being perfectly capable of reliably bearing the impact of any vehicle thereon.

Referring now to the support member 2 in greater detail, it is seen that this member is made from a one-piece body of plastic material such as PVC, nylon, polyethlene, etc. The body includes first, second and third support portions 7, 8 & 9 for the reinforcing bars 3, 4 and 5 respectively. Portion 7 and 8 are composed of a surrounding wall which has an opening through which the associated reinforcing bar can be inserted. Section 9 is a rest with no side support formed by the intersection of the transverse members. As seen in FIG. 2, portion 7 has an opening 10 while portion 8 has an opening 11. By contrast section 9 has no opening. Portions 7 and 8 in horizontally aligned relation so that the reinforcing bars will be parallel to each other on the same plane.

The body furthermore includes a first upper pair of diagonally projecting arms 12 and 13. The arms 12 and 13 are located at the same level and extend diagonally so as to engage the intersection of the inclined side walls 22 & 24 and 23 & 25 of form 1 at points 15, 16. The ends of the diagonal arms are all rounded so as to define clearly the contact thereof with side walls of the form. As a consequence of the two points of support of the arms on the support member at the intersection of inclined side walls of the form, the support 2 will be stably supported and laterally restrained.

At the bottom of the support member there are further projecting arms 17 and 18, which contact the bottom wall 21 of the form at 19 and 20. The arms 17 and 18 are of cylindrical shape so as to provide a definite line of contact at 19 and 20. As can be seen, the arm 17 and 18 are aligned with the connecting pieces 26 and 28, 27 and 29. Thereby reinforcing members 3 and 4 will be precisely positioned on axis Y—Y, and reinforcing member 5 along axis X–Y of form 1.

The operation of installing the reinforcing bars within the form is as follows:

Each reinforcing bar is inserted through the associated opening into the corresponding support portion of at least two supports 2. The size of the opening in each support is such that the reinforcing bar is forcibly inserted into its supporting portion. The free ends 14 of the supporting portion 7 and 8 are so positioned to forcibly hold the reinforcing bars 3, 4 within the supporting portion.

The supporting portion 9 is formed by the intersection of section 26 and 27 and bar 5 is placed thereon.

The assembly of bars and supports is then inserted into the corresponding parking curb form, and the ends of the diagonally projecting arms contact the side walls of the form. It is also possible to first position the supports 2 in the form and then insert the reinforcing bars 3, 4 & 5 into the same. In either case, the reinforcing bars will be exactly positioned and stably held in position within the cast concrete parking curb.

In order to insure the tight engagement of the free ends 14 of the support portions 7 & 8 with the reinforcing bars 4 & 5, the arms 12 & 13 are connected to the connecting pieces 27 & 28 and 26 & 29 respectively thereby leaving the ends 14 free to elastically deform.

Referring to the embodiment illustrated in FIG. 1 showing a perspective view of a concrete form with the previously described embodiments, it will be seen that there has been disclosed in combination, a concrete form of inverted semi-trapezoidal cross-section including a bottom wall and side walls connected thereto, a plurality of parallel reinforcing rods which are located in the form and at least one monolithic plastic reinforcing rod support holding the reinforcing rods in position in the inverted trapezoidal concrete form.

In general, the aforesaid support includes a frame and support portions on the frame for elastically receiving and retaining the reinforcing rods. Two of the support portions are located at a higher level in the form and a third optional support in the lower level. The higher support portions open directly upward. As a result, forces which tend to implant a reinforcing rod therein, will be accommodated directly and will tend simply to urge the extremities of the support more tightly against the opposing side wall of the concrete form. The lower support portion does not provide a grip but the forces created by the weight of the reinforcing rod thereon will tend to urge the bottom of the support more tightly against the intersection of the bottom and the sides of the form respectively.

Moreover, it will be noted that the frame provided in accordance with the invention, include diagonally extending portions engaging against the side walls and adapted for being urged against the side walls of the concrete form by the weight of the reinforcing rods when accommodated in the supporting portions or sockets.

Although the invention has been described in relation to a specific embodiment thereof, it is clear that numerous modifications and variations will become evident to those skilled in the art without departing from the scope and spirit of the invention as defined by the attached claims.

What is claimed is:

1. A plurality of parallel reinforcing rods and at least one monolithic parking curb reinforcing rod support; said support including a frame having first and second support portions and a third optional support portion receiving and retaining said reinforcing rods, the first and second support portions being located at a higher level than the optional third of the support portions; said first and second support portions opening directly upwards and including a surrounding wall with an opening through which a reinforcing rod can be inserted, means connecting said first and second support portions and projecting members defining a plurality of support points by which said parking curb reinforcing rod support can be stably supported in a form and the reinforcing rods placed at predetermined positions within said form whereby upon the casting of concrete within said form the reinforcing rods will be placed at predetermined positions therein; said first and second support portions each mutually aligned with two parallel projections and said connecting means comprising diagonal connection pieces joining said projections to the bases of the first and second support portions, the juncture of the intersection of said connection pieces defining the third optional support portion for receiving a reinforcing rod, said projecting members including one pair of arms extending diagonally from the bases of the first and second support portions respectively.

2. The invention as in claim 1 wherein said projections are cylindrical.

3. The invention as claimed in claim 1 wherein said arms of said pair extend to a common level diagonally from the first and second support portions.

* * * * *